US006837402B2

(12) United States Patent
Cardia

(10) Patent No.: US 6,837,402 B2
(45) Date of Patent: Jan. 4, 2005

(54) DEVICE FOR THE CONTROLLED DELIVERY OF LIQUIDS AND/OR CREAMY SUBSTANCES AND/OR FLOWABLE SUBSTANCES

(76) Inventor: Ennio Cardia, Via Durazzo, 18-00198 Rome (IT)

( * ) Notice: Subject to any disclaimer, the term of this patent is extended or adjusted under 35 U.S.C. 154(b) by 150 days.

(21) Appl. No.: 10/148,668

(22) PCT Filed: Dec. 1, 2000

(86) PCT No.: PCT/IT00/00499

§ 371 (c)(1),
(2), (4) Date: Jun. 3, 2002

(87) PCT Pub. No.: WO01/46065

PCT Pub. Date: Jun. 28, 2001

(65) Prior Publication Data

US 2002/0179648 A1 Dec. 5, 2002

(30) Foreign Application Priority Data

Dec. 3, 1999 (IT) ..... RM99A0739

(51) Int. Cl.[7] ..... B67D 5/06

(52) U.S. Cl. ..... 222/205; 222/207; 222/212; 222/456

(58) Field of Search ..... 222/158, 205, 222/207, 212, 454, 456

(56) References Cited

U.S. PATENT DOCUMENTS

| | | | | |
|---|---|---|---|---|
| 4,324,349 A | | 4/1982 | Kaufman | 222/207 |
| 4,516,697 A | | 5/1985 | Dreps et al. | 222/212 |
| 5,125,541 A | | 6/1992 | Anglehart | 222/158 |
| 5,224,632 A | * | 7/1993 | Murakami et al. | 222/205 |
| 5,261,569 A | * | 11/1993 | Sandwell | 222/205 |
| 5,358,152 A | * | 10/1994 | Banks | 222/442 |
| 5,363,991 A | * | 11/1994 | Reyman | 222/207 |
| 6,334,550 B1 | * | 1/2002 | De Backer | 222/205 |

FOREIGN PATENT DOCUMENTS

| | | |
|---|---|---|
| DE | 81 32 798.6 | 3/1982 |
| DE | 91 06 473.2 | 9/1991 |
| EP | 0 160 139 | 11/1985 |
| EP | 0 381 230 | 8/1990 |
| EP | 1 114 778 | 7/2001 |
| FR | 2 442 195 | 6/1980 |
| WO | WO 86/00404 | 1/1986 |

* cited by examiner

*Primary Examiner*—Joseph A. Kaufman
(74) *Attorney, Agent, or Firm*—Young & Thompson

(57) ABSTRACT

A device (4) for the controlled delivery of a product (P), such as liquids and/or creamy substances and/or flowable substances within a container (1), in such a way that in the delivery position the product (P) column to be delivered is in a raised position with respect to the device (4), said container (1) being comprised of a material, deformable by squeezing and able to energetically returning to its original shape, once the squeezing action is interrupted, and being provided with a neck (15), and optionally a cap element (2), coupled with the neck (15), and provided with an outlet opening (3) for the product to be delivered toward said device. The device (4) comprises elements for the controlled delivery of the product, which include a first inner conduct (5), communicating (3) inside the container, a second inversion conduct (7), communicating (6) with said first inner conduct (5), and a third outer conduct (9), communicating (8) with the inversion conduct (7) and provided with product (P) delivery opening (10).

25 Claims, 3 Drawing Sheets

DEVICE FOR THE CONTROLLED DELIVERY OF LIQUIDS AND/OR CREAMY SUBSTANCES AND/OR FLOWABLE SUBSTANCES

BACKGROUND OF THE INVENTION

The present invention relates to a device for the controlled delivery of liquids and/or creamy substances and/or flowable substances, allowing to control the outlet of the substance contained within the container, automatically interrupting the outlet after the squeezing action on the same container.

Containers are known, provided with elastic systems allowing to open and close an opening, and mainly comprised of plastic material, in order to try to obtain a controlled delivery.

Solutions available on the market that are complicated and expensive are not able to realise a device that can be manufactured with reduced costs.

Differently to the known solutions, the solution suggested according to the present invention, does not provide elastic systems, since the substance to be delivered is not stopped by the closure systems, but it is interrupted by the dynamic action of the atmospheric pressure, not providing closure walls between the delivery opening and the inside the container.

The solution suggested according to the present invention can be realised with very low costs, and it is substantially suitable to deliver any kind of liquid or fluid product, such as low density liquids, as water and beverages; medium density liquids, such as high density liquid soaps, sauces, fluids, for example low density creamy substances.

SUMMARY OF THE INVENTION

It is therefore a specific object of the present invention to realize a device for the controlled delivery of a product, such as liquids and/or creamy substances and/or flowable substances within a container, in such a way that in the delivery position the product column to be delivered is in a raised position with respect to said device. The container being comprised of a material, said material being deformable by squeezing and able to energetically return to its original shape, once the squeezing action is interrupted. The container being provided with a neck, being further provided with a cap element, coupled with said neck, and provided with an outlet opening for the product to be delivered toward said device. The controlled delivery device being characterised in that it comprises means for the controlled delivery of the product, said means for the controlled delivery comprising a first inner conduct, communicating inside the container, a second inversion conduct, communicating with said first inner conduct, and within which the run of the product is directed according to a direction substantially opposed to the gravity force during the delivery phase, without passage of outer air toward the inside of the container, and a third outer conduct, communicating with said inversion conduct and provided with product delivery opening. The inlet opening of the inversion conduct being realised in such a way to prevent the entrance of air within the conduct, when the product during its exit from inside the container has reached the inversion conduct.

BRIEF DESCRIPTION OF THE DRAWINGS

The present invention will be now described, for illustrative but not limitative purposes, according to its preferred embodiments, with particular reference to the figures of the enclosed drawings, wherein:

FIGS. 20 and 22 show modifications provided with opening and closure system of the product delivery, the first one with a pushing and pulling axial system, the second one by roto-translation.

DETAILED DESCRIPTION OF THE PREFERRED EMBODIMENTS

In the various views, the corresponding parts will be indicated by the same references.

Figure 1A:
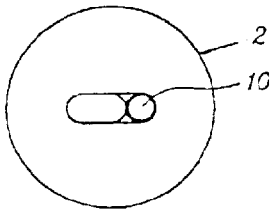
FIGS. 1*a* and 2*a* are top views only of caps of the FIGS. 1 and 2.
Figure 1:
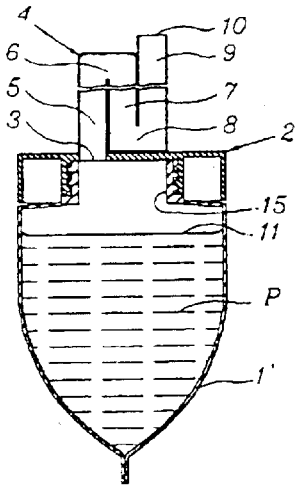
FIG. 1 and FIG. 2 respectively show a tube shaped container and a bottle shaped container, both closed by a closure cap provided with a product control device with a S-shaped conduct.

Referring to FIG. 1, it is shown a tube shaped container, having a base realised by welding of its final end, filled in with product P to level 11, in a not-delivery position, having a cap 2 closing by threading on its threaded neck 15.

Figure 2A:
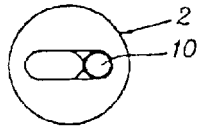
Figure 2:
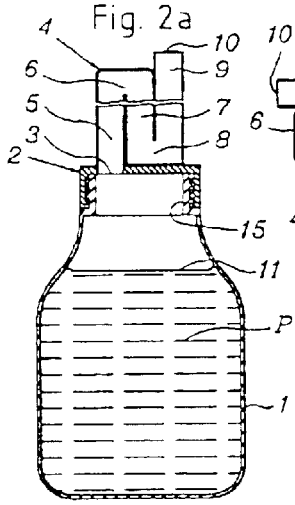

In FIG. 2, it is shown a bottle shaped container 1 in a vertical position, resting on its base, filled in with the product P up to the level 11, having a cap 2 closing by threading on its threaded neck 15.

Both containers of FIG. 1, tube 1', and of FIG. 2, bottle 1, provide the cap 2 with an opening 3 allowing the product P to pass within the delivery control device, generically indicated by the reference number 4, realised by a S-shaped conduct, before being delivered through the delivery opening 10, following the squeezing of the tube 1' or of the bottle 1.

Both containers must be comprised of tough and elastic material in such a way to have the force of returning after their squeezing to the original shape.

S-shaped conduct, determining the product P delivery control device 4, is comprised of the following three parts placed according to the following sequence:

a first inner conduct 5, having its inlet end at the opening 3 of the cap 2, communicating with inside of the container 1, or 1' axially outwardly directed;

a second conduct, or inversion conduct 7, within which the path of the product P is directed according to a direction substantially opposed to the gravity force in the delivery position, having a first end, or inlet end 6, communicating with said opening of the second end of the first inner conduct, and a second end provided with an opening, of outlet opening 8;

a third outer conduct 9 having a first end communicating with said outlet opening 8 of the second end of the inversion conduct and a second end provided with product P delivery opening 10.

In FIG. 1*a* and FIG. 2*a* top views of the cap 2 are shown, without tube 1' or bottle 1, provided with the S-shaped control device 4 having a circular delivery opening 10.

In the figures, length of the conducts is shown interrupted, since it will be chosen in function of the specific use.

In the following figures, caps 2 are shown, provided with product P control device 4, closed on the bottle shaped containers 1, taking into account that they can also be used on tube shaped containers 1'.

Figure 3:
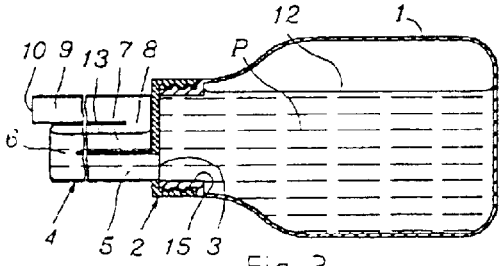

In FIG. 3 it is illustrated container 1of FIG. 2, rotated 90°, having the delivery opening 10 in an outwardly directed horizontal position.

When container 1, having the delivery opening 10 directed upward and the upper level of the product communicating with the outer air, starts rotating from its vertical position of FIG. 2 to the horizontal position of FIG. 3, product P moves to reach the opening 3 of the cap to pass within the inner conduct 5.

As soon as the product P has reached the inlet opening 6, between the inner conduct 5 and the inversion conduct 7, outer air can no more enter within the container.

When the container 1 is rotated 90°, air remaining inside moves upwards, to reach the upper side of the container 1, determining a corresponding level 12 of the product P in a not-delivery position.

Since the inner level is in a raised position with respect to the inlet opening 6, between inner conduct 5 and inversion conduct 7, product P tends to exit passing through the inversion conduct.

There is no air entering corresponding to the product P tending to exit.

Level 12 of inner product P tends to lower to the position indicated in FIG. 3, and air remained within the container 1 tends to increase its volume and correspondingly to diminish the pressure, with respect to the initial position when the product P reached the inlet opening 6.

Product P, tending to exit through the inversion conduct 7, while its level moves within the inversion conduct 7, is at the same time returned inside, since on the outer conduct 9 a higher outer pressure with respect to the air pressure remained within the container 1 is present, said inner pressure decreases while the product P exits and moves within the inversion conduct 7.

Equilibrium of product P within the inversion conduct 7 is reached when the depression of the air remained within the container is able to call back by sucking the weight of the product P column raised with respect to the inlet opening 6.

If the outlet opening 8, between the inversion conduct 7 and the outer conduct 9, is raised with respect to the dynamic equilibrium level 13 reached in the inversion conduct 7, the product P does not exit from the delivery opening 10 provided on the end of the outer conduct 9.

In this situation, the exit of the product P stops at the dynamic equilibrium level 13 within the inversion conduct 7, thus preventing the dropping through the delivery opening 10.

If the body of the container 1 is subjected to a squeezing action, shrinks its inner volume, thus modifying the equilibrium, and the product P is compressed and forced to exit within the conducts of the delivery control device 4 through the delivery opening 10.

If the container 1 is comprised of tough and elastic material, once the squeezing action of the container is interrupted the container 1, in view of the material by which it is made up, comes back to the original shape sucking both the product P remained within the conducts 5, 7, 9 and once the product P within the conducts 5, 7, 9 is back within the container 1, outer air enters again, compensating the amount of product P exited.

In conclusion, when the container is again in its original shape, the above situation is restored, with the dynamic equilibrium level reaching a lower level with respect to the outlet opening 8, thus preventing dropping of the product.

By the delivery control device 4 suggested according to the present invention, product P can only exit following to a squeezing action of the container 1. Once interrupted the squeezing phase of the container 1, product P automatically stops, due to the outer atmospheric pressure dynamically controlling the equilibrium level 13 within the inversion conduct 7.

Dynamic equilibrium level 13 can vary also as a consequence of outer temperature variations of the container 1, since air remained inside can vary in volume due to the temperature variation and said volume variation can exert a further pressure on the product level that, pushed to exit, would modify the dynamic equilibrium level reached within the inversion conduct 7. This effect is more sensitive in function of the higher quantity of air remained within the container 1. When the container is rotated of 180° with respect to the position shown in FIG. 2, or of 90° with respect to the position of FIG. 3, takes the position of FIG. 4 where the container is in a upset position, with the delivery opening 10 downward directed.

Also in this case, if the dynamic equilibrium level 13 is realised within the inversion conduct 7, product P does not pass the outlet opening 8, it does not exit, and exits after the squeezing of the container 1, even in presence of a product P column at a higher level with respect to the delivery opening 10.

Figure 5:
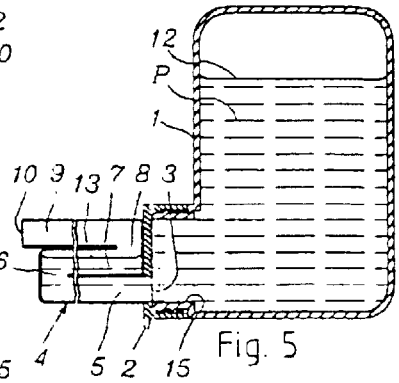
FIGS. 5, 6, 7 and 8 show some modifications of the container of FIG. 4.

In FIG. 5 it is shown a different embodiment of the container 1 of FIG. 3, with the container axis placed at 90° with respect to its neck in such a way to have a lateral delivery from a vertical container.

Figure 4:
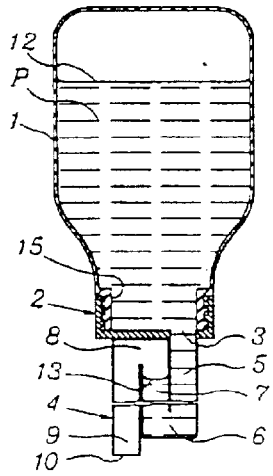
FIGS. 3 and 4 show containers of FIG. 2 respectively rotated of 90° and 180°.
Figure 6:
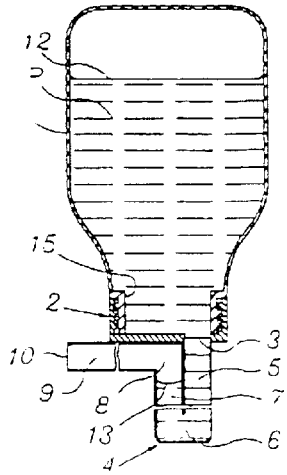

In FIG. 6, it is shown a different embodiment of the container 1 of FIG. 4, wherein the outer conduct 9 is realised at 90° with respect to the inversion conduct 7 in such a way to have a lateral delivery with the container 1 upside-down.

Figure 7:
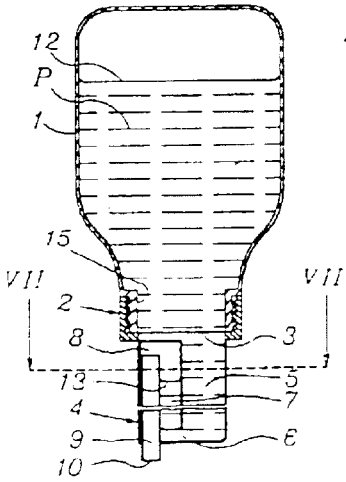

In FIG. 7 is shown a different embodiment of the delivery control device 4 of FIG. 4, wherein conducts 5, 7, 9, have different shape with respect to those of the previous embodiments, even if the product P runs also in this case a S shaped path before exiting from the delivery opening 10.

Figure 7A:
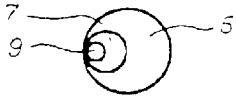
FIG. 7*a* shows section VII—VII of embodiment of FIG. 7.

In this case, conducts 5, 7, 9 are realised with different diameters, wherein the outer conduct 9 is placed inside the inversion conduct 7, and both of them are placed inside the inner conduct 5, laterally displaced to have all of them adjacent lateral walls. Section along axis VII—VII of said configuration of the conducts 5, 7, 9 is shown in FIG. 7*a*.

Figure 8:
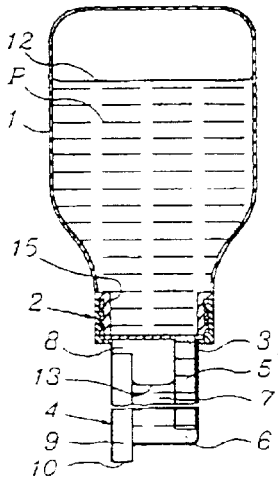

In FIG. 8 a different embodiment of the delivery control device 4 of FIG. 4 and of FIG. 7 is shown, wherein conducts 5, 7, 9 have a different shape with respect to the previous solutions, even if the product P, before exiting, runs a S shaped path.

Inner 5 and outer 9 conducts are both placed within the inversion conduct 7, that is realised with a very larger diameter, and are placed in a position opposite each other within the inversion conduct 7.

In the present embodiment, it is necessary a higher product volume P to carry out a corresponding variation of the dynamic equilibrium level 13 within the inversion conduct 7.

This solution, with respect to the preceding ones, is less sensitive to the variations of the dynamic equilibrium level due to the temperature variations acting by volume and pressure variations on the air remained within the container 1, variations acting on the surface of the inner product, thrusting the same to exit or to return in function of the fact that the temperature is higher or lower with respect to the equilibrium conditions reached during the last product P exit.

In the following figures, from FIG. 9 to FIG. 14, some applications are shown of the embodiments previously illustrated, with the container 1 represented as a partial view of its final part provided with the neck, with the delivery opening upward directed, in a resting position, and the delivery opening downward directed in a upset position.

Figure 10:
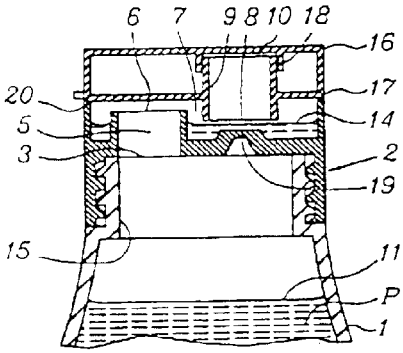
FIGS. 9 and 10 show the final end of a container provided with a cap having a product control device and a laterally hinged cover, suitable for sauces.
Figure 9:
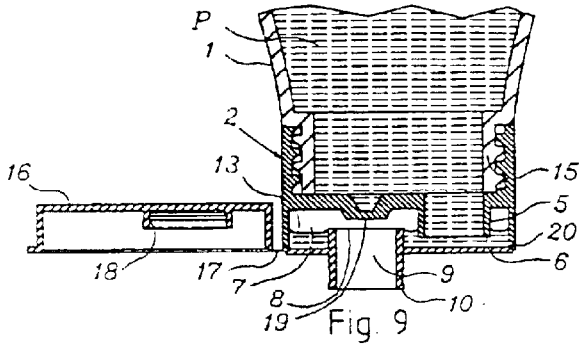
Figure 11:
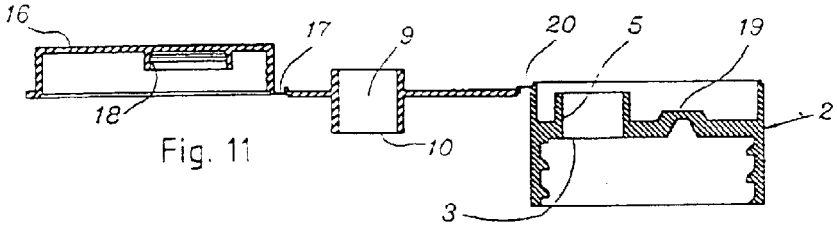
FIG. 11 shows the cap provided with product control device and cover disassembled and realised as a single pressed piece, provided with two lateral hinges for assembling.

In FIGS. 9, 10 and 11 it is shown the final end of a container 1, having a very reduced height of the delivery control device 4, suitable to very dense liquids like sauces, more specifically tomato sauce.

A cover 16, provided with a lateral hinge 17 on its upper end of the inversion conduct engages by a snapping closure 18 on the final end of the delivery opening 10, as indicated in FIG. 10. This solution is also used for the containers described in the following FIGS. 12, 13, 14.

Inner conduit 5 and outer conduit 9 are placed on two different bodies, engaged by pressure, snapping, or ultrasound welding, to realise a recipient 7 corresponding to the inversion conduct.

Inner conduct 5 is moved toward the right side, the inner wall of which is adjacent and corresponding to the inner wall of the neck 15 of the container 1, while the outer conduct 9 is positioned slightly on the left and is realised, with respect to the previous embodiments, shorter in its inner part of the inversion conduct 7, in order to have the end faced toward the cap 2, creating the exit opening 8, far enough from the latter.

After the delivery, when the container 1 goes back to its not delivery position, FIG. 10, with the base of the container at the bottom and delivery opening 10 upward, the product remained within the inversion conduct 7 and in the inlet opening 6, as illustrated in FIG. 9, inverts, thus occupying the new upset position in the opposed surface of said inversion conduit, as illustrated in FIG. 10.

It is suitable that level 14 of the product in the not-delivery position within the inversion conduct 7, see FIG. 10, is lower than the end toward the cap 2 of the outer conduct 9, determining the outlet opening 8 of the inversion conduct 7, so that the inner air remained within the contained 1, if subjected to positive volume and pressure variation due to positive temperature variation, can exit passing through the product level 14 and the inner end of said outer conduct 9, determining said exit opening 8 of the inversion conduct 7.

To prevent dropping of the product, the inner end of the outer conduct 9, that is inside the inversion conduct 7, see FIG. 9, must be in any case at a level higher than the end opposite to the inner conduct 5, determining the inlet opening 6 of the inversion conduct 7, to ensure that outer air cannot enter within the container 1 in a upset position.

A covering wall 19, realised by the bottom wall of the cap s, slightly distant from the inner end of the outer conduct 9, corresponding to the outlet exit 8, allows to prevent that some product P that remains entrapped within the inversion conduct 7, above said outer conduct 9, can exit in a not checked way, through said outer conduct 9 from the delivery opening.

This solution is also used in the containers shown in the following FIGS. 12, 13, 14, 19, 20, 21 and 22.

Cap 2, control device 4 and cover 16 of FIGS. 9 and 10 can be realised, as illustrated in FIG. 11, as a single pressed body, comprised of three bodies coupled to each other by lateral hinges 17, 20, then closed and assembled.

Figure 12:
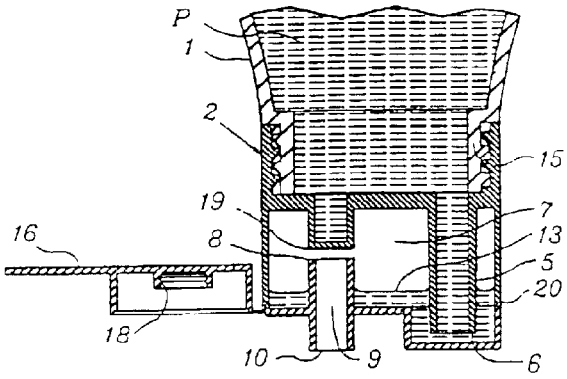
FIGS. 12, 13, 14 show modifications of FIGS. 9, 10, 11, suitable for low density and low capillarity liquids.

In the solution shown in FIG. 12, suitable for low density liquids, the inversion conduct 7 has a higher height to allow that the dynamic equilibrium level 13 has the possibility of reaching a higher height and a bigger excursion in case of temperature variations.

The inversion conduct 7 has a lower portion wherein the tubular wall surrounds the end of the inner conduct 5, while the upper portion has an outer wall corresponding to the outer wall of the cap 2.

This solution has the advantage of limiting the amount of product P necessary to reach the dynamic equilibrium level 13, and therefore to limit the amount of product remained within the inversion conduct 7 when the container is upset.

Figure 13:
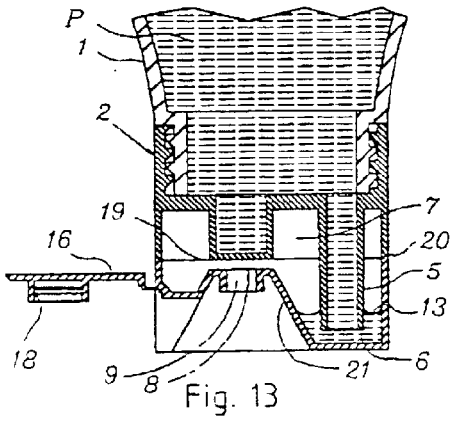

In the solution shown in FIG. 13, suitable for medium density liquids having a certain degree of capillarity, such as soaps, the inversion conduct 7 has a lower wall 21 provided with an upwardly directed recess, to allow the outer conduct 9 to be very short, even if the inner end, corresponding to the outlet opening 8 of the inversion conduct 7, is positioned at a medium height of said inversion conduct.

After the delivery, even if product P is sucked, an amount corresponding to a thin film remains adhering by capillarity and after a few seconds, due to gravity, tends to descend and to create a residual dropping of one or two droplets.

In this embodiment, this effect is substantially eliminated, by making the conduct really short to limit the maximum the amount of product P that can be deposited by capillarity.

Figure 14:
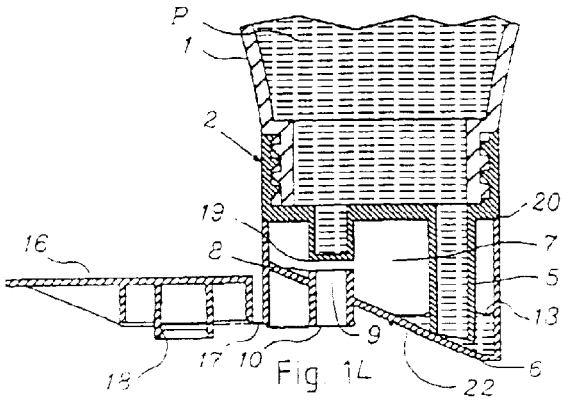

In the embodiment of FIG. 14, inversion conduct 7 has a sloping wall 22, to obtain the advantages of the embodiment of FIG. 12, i.e. a wall surrounding the final end of the inner conduct 5, and those of FIG. 13, i.e. the outer conduct 9 very short.

In FIGS. 12, 13, 14, cap 2, control device 4 and cover 16 of FIGS. 9 and 10 can be made up as a single pressed body, or as shown in FIG. 11, comprising three bodies, coupled to each other by lateral hinges 17, 20, then closed and assembled.

Figure 15:
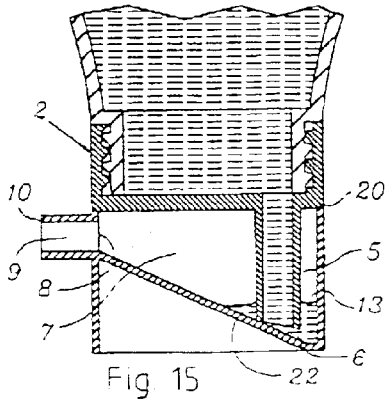
FIG. 15 shows a modification of FIG. 14 with a lateral delivery, more suitable for liquids subjected to capillarity.

In FIG. 15, it is shown a modification of FIG. 14 more suitable for medium density liquids having a certain capillarity degree, such as soaps, since the container 1 is realised to stably remain in a upset position, and the outer conduct 9 is realised with a 90° angle with respect to the inversion conduct 7, to have a lateral exit of the product P.

Being that the outer conduct 9 is horizontal, and even better if it is slightly sloped upward, after the delivery of product P, the product P that remained by capillarity, tends to descend within the inversion conduct 7, under the gravity force, preventing the residual dropping from the delivery opening 10.

In the following figures, from FIG. 16 to FIG. 20, containers 1 are shown, having the control device 4 for the product P delivery provided inside the container, with the outer conduct placed on the cap 2 or on a movable bottom coupled to the same.

Figure 16:
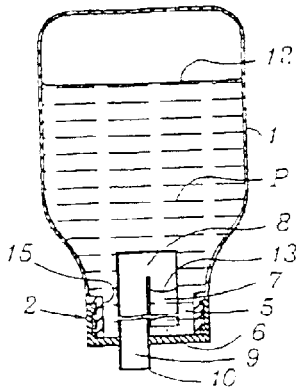
FIG. 16 shows a container provided with a cap with product control device provided within the container.

In FIG. 16, in the simplest solution, the inversion conduct 7 and the outer conduct 9 are realised with the same section within the inner conduct 5 comprised of the inner wall of the neck 15 of the container 1.

In FIGS. 17, 17*a*, 18, 18*a* it is shown a container having a rotation closure and opening system of the cap 2, snapping coupled on the container 1, able to open or to close the inner end of the outer conduct 9.

A tubular receptacle 23, provided with a bottom 24, having on the opposite end an annular flange 25 faced outwardly, engaging on the edge of the container 1 neck, realises, along with the bottom of the rotating cap 2, the inversion conduct 7.

Figure 17:
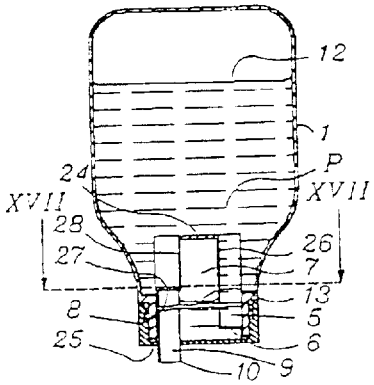
FIG. 17 and FIG. 18, with a view rotated of 90°, show a modification of FIG. 16, having an opening and closure system of the product delivery by 90° rotation.
Figure 18:
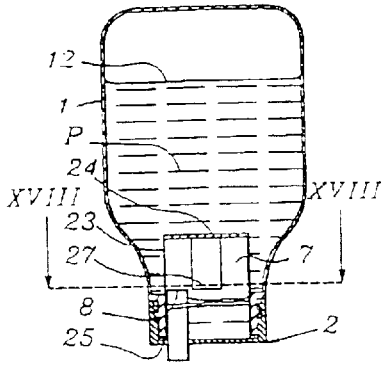
Figure 17A:
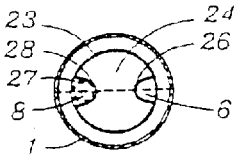
FIGS. 17*a* and 18*a* respectively show sections XVII—XVII and XVIII.XVIII of FIGS. 17 and 18.
Figure 18A:
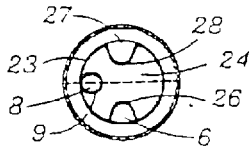

Two opposite tubular C shaped recesses are realised on the outer tubular wall of the inversion conduct 7, see FIGS. 17*a*, 18*a*, one 26 of which making part of the inlet conduct 5 along with the remaining part of the corresponding inner surface of the container 1 neck.

On the bottom of said tubular recess 26, close to the cap 2, it is realised an inlet opening 6 allowing the entrance of the product P within the inversion conduct 7.

On the opposite side, following to the rotation of the cap 2, the outer conduct 9 rotates within the inversion conduct, while its inner end, realising the outlet opening 8, is closed by a closure bottom wall 27 obtained by the opposed tubular C shaped recess 28.

Rotating the cap 2, the outer conduct 9 rotates of 90° with respect to the container 1 and to the receptacle 7 realising the inversion conduct, FIGS. 18, 18*a*, and the inner end of the outer conduct 9 rotates with respect to the closure bottom wall 27 realised on the bottom of the opposed tubular C shaped recess 28, thus allowing to the product P to exit from the delivery opening 10 of the outer conduct 9.

This solution allows to have one body less, corresponding to the closure cover 16, and a better use practicality.

Figure 19:
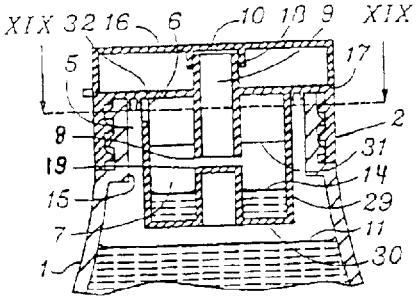
FIGS. 19, 19*a*, 20, 21, 22 show the modifications of the final ends of containers of FIGS. 16, 17, 18, where

In FIG. 19, it is shown a container 1 having the product P control device inside, with the outer conduct on the cap 2.

As in FIG. 10, said container 1 is provided with a cover 16 engaged by a lateral hinge with the cap 2, with an inner end of the outer body 9, corresponding to the outlet opening 8, substantially placed at half height of the inversion conduct 7 and slightly distant from a cover wall 19 obtained from the bottom wall of the cap 2, and with an inversion conduct 7, having a diameter slightly more little than the inner wall of the container 1 neck 15.

Figure 19A:
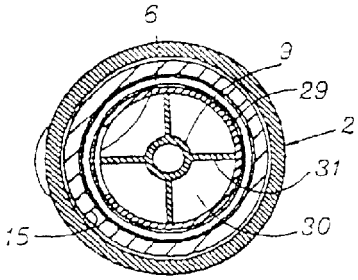

A receptacle 29, having closed bottom and opposite end free, realising along with the bottom of the cap 2 the inversion conduct 7, is pressure coupled, or ultrasound glued, with the edges of the cross vertical walls 31 projecting from the inner portion of the outer body 9, see FIG. 19*a*.

On the edge 32 of the receptacle 29, contacting the bottom of the cap 2, it is realised the inlet opening 6, to allow to the product to enter within the inversion conduct 7.

Figure 20A:
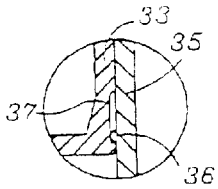
Figure 20:
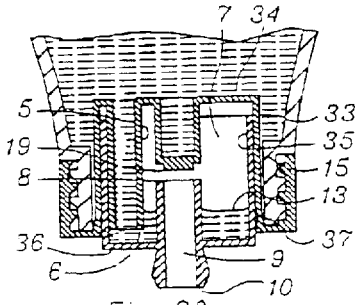

In FIG. 20, it is shown a container 1 having an axial opening and closing system of the push and pull kind, for the inner end of the outer body.

A cap 2 threaded on the neck 15 of the container 1 is provided with a bottom re-entrant within the container, thus determining a first inner receptacle 33, provided with tubular wall adjacent to the inner tubular wall of the container 1 neck 15, and with a bottom surface 34, the latter making part of the inversion conduct 7.

A second slidable tubular receptacle 35, with a bottom provided with outer conduct 9, tubular wall, realising the remaining part of the inversion conduct 7, and opposite end opened, is slidably, sealing, telescopically inserted, in a upset position, within the tubular wall of the first inner receptacle 33 obtained from the cap 2 recess.

Axial engagement means are realised by an annular projection 36, comprising a little edge on the second slidable tubular receptacle 35, sliding within an annular groove 37 obtained on the final end of the inner wall of the first inner receptacle 33, realised from the cap 2 recess.

Inner conduct 5, having the base on the bottom of the first inner receptacle 33 and opposed end slightly far from the bottom of the second slidable tubular receptacle 35, allows to the product to enter through the inlet opening 6 into the inversion conduct 7.

In the delivery position, the inner end of the outer conduct 9, corresponding to the outlet opening 8, is slightly far from the covering wall 19 obtained from the bottom wall of the first inner receptacle 33.

Instead, in the closure position, the second slidable tubular receptacle 35, bringing the outer conduct 9, is pushed within the first inner recipient 33, in such a way that the inner end of the outer conduct 9 can close on the covering wall 19 realised from the bottom wall of said inner receptacle 33 and consequently closing said outlet opening 8 by closing the conduct 9.

In this situation, product P is prevented from exiting, determining, as in FIG. 17, an arrangement with a reduced number of bodies, namely the closure cover 16, and a better use practicality.

Figure 22:
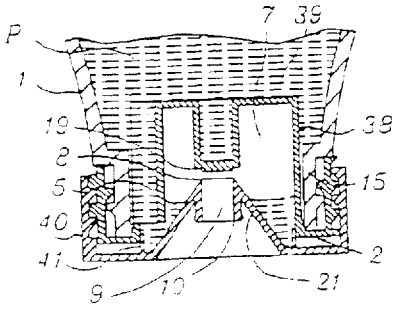
Figure 21:
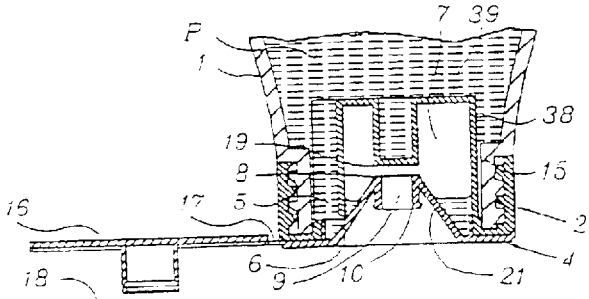

In FIGS. 21 and 22, containers are shown, having the product P control device within the container 1, suitable for liquids having capillarity.

In FIG. 21, it is shown a container 1, as in FIG. 20, having a cap 2 threaded on the neck 15 of the container 1 and provided with a bottom re-entrant within the container thus determining a first inner receptacle 38, said receptacle being obtained from the recess of the cap 2, provided with tubular wall adjacent to the inner tubular wall of the container 1 neck 15, and with a bottom surface 39, the latter making part of the inversion conduct 7.

As in FIG. 17, on the outer tubular wall of said first inner receptacle 38, it is realised a C shaped tubular recess 26, making part of the inlet conduct 5, along with the remaining part of the corresponding inner surface of the container 1 neck.

On the bottom of said tubular recess, close to the cap 2, it is realised an inlet opening 6 allowing the entrance of the product P within the inversion conduct 7.

A cover 16, having a lateral hinge 17 on the upper end of the inversion conduct, engages, by a snapping closure, on the final end of the delivery opening 10.

As in FIG. 13, a second element, provided with a lateral hinge 20 on the upper end of the cap 2, is assembled by a snapping system, or ultrawave welded, to realise the surface of the lower part of the inversion conduct 7 with an upwardly directed recess 21, to allow to the outer conduct 9 to be extremely short, even being the inner end placed at the medium height of the inversion conduct 9.

As indicated in FIGS. 10, 12, 13, 14, a cover 16, provided with a lateral hinge 17 on the upper end of the control device 4, engages by a snapping closure on the delivery opening 10, while the inner end of the outer body 9 is substantially placed at a half height of the inversion conduct 7, and slightly far from a covering wall 19 obtained from the bottom wall of the inversion conduct 7, corresponding to the first inner receptacle 38.

In FIG. 22, it is shown a container 1, having a structure similar to the one of FIG. 21, provided with a closure and opening system for the outlet opening 8 by screw rotation of a closure and opening movable body 40 placed above the cap 2 snapping engaged on the container 1 neck 15, said screw rotation of the closure and opening movable body 40 able to open or to close the inner end of the outer conduct 9.

The closure and opening movable body 40 in its central part realises the lower part of the inversion conduct 7, said central part being provided with an upwardly directed recess 21, to allow the outer conduct 9 to be extremely short, even if the inner end is placed at the half height of the inversion conduct.

In the delivery position, the inner end of the outer conduct 9, as in FIG. 20, is slightly far from the covering wall 19 obtained from the bottom wall 39 of the first inner receptacle 38, obtained from the recess of the cap 2.

In the closure position, by screwing of the closure and opening movable body 40, bearing the outer conduct 9, is pushed within the first inner receptacle 38, in such a way that the inner end of the outer conduct 9 can close on the covering wall 19 obtained from the bottom wall 39 of the inversion conduct 7, corresponding to the first inner receptacle 38.

An annular wall 41 projecting from the bottom surface of the closure and opening body 40, realising the lower part of the inversion conduct 7, guarantees a hermetical sealing by a pressure slidable coupling with the inner tubular wall of the first inner receptacle 38 obtained from the recess of the cap 2.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. A device for the controlled delivery of a flowable product within a container, said container comprising a material that is deformable by squeezing and able to energetically return to an original shape once the squeezing action is interrupted, said container having a neck and an outlet opening for said product to be delivered toward said device, said controlled delivery device comprising:

means for controlling delivery of the product, so that in a delivery position the product to be delivered is in a raised position with respect to said device, said means for controlling delivery comprising a first inner conduct communicating with said outlet opening; a second inversion conduct having a first end communicating with said first inner conduct, and within which the product is directed according to a direction substantially opposed to gravity force during delivery of the product, without passage of outer air inside of the container; and a third outer conduct having a first end communicating with a second end of said inversion conduct and having a delivery opening at a second end;

wherein said first end of the inversion conduct is structured and arranged to prevent entrance of air within the container, when the product has reached the inversion conduct during an exit of the product from inside the container.

2. The device for the controlled delivery of a product according to claim 1, wherein said inversion conduct allows, during the lowering of a level within the container, a corresponding inner entrapped air volume and depression increase to be able to return by sucking the product with respect to the first end of the inversion conduct thus allowing the product to reach a dynamic equilibrium level within said inversion conduct, with a dynamic equilibrium between said first end of the inversion conduct and the second end of the inversion conduct to prevent dripping due to exit of the product through the delivery opening.

3. The device for the controlled delivery of a product according to claim 1, wherein the material of said container is sufficiently tough and elastic suitable to determine an outlet control action of the product by squeezing the container, so that when the container is squeezed, a volume of the product contracts within the container to compress and to force said product to exit, such that a dynamic equilibrium level rises within the inversion conduct, so that the product passes the outlet opening to exit through the delivery opening.

4. The device for the controlled delivery of a product according to claim 1, wherein the material of said container is a material sufficiently tough and elastic to have memory to energetically return to its original shape once the deformation action is interrupted, suitable to suck both the product remaining within each of the conducts, to prevent residual dripping, and to suck air once the product from the conducts is returned within the container, in order to compensate for an amount of product dispensed and to restore the initial situation wherein the dynamic equilibrium level of the product within the inversion conduct is in a lower position with respect to the product column to be delivered and automatically stops, stopped by the outer atmospheric pressure dynamically controlling the same.

5. The device for the controlled delivery of a product according to claim 1, wherein said container is a bottle, a tube, or any other shape.

6. The device for the controlled delivery of a product according to claim 1, wherein said outer conduct is oriented substantially parallel or perpendicular to the inversion conduct.

7. The device for the controlled delivery of a product according to claim 1, wherein said inner conduct, said inversion conduct and said outer conduct are placed side by side to independent conducts; or the inner conduct is placed side by side to the inversion conduct, and the inversion conduct contains the outer conduct; or the outer conduct is placed side by side to the inversion conduct, and the inversion conduct contains the inner conduct.

8. The device for the controlled delivery of a product according to claim 1, wherein said inner conduct, said inversion conduct and said outer conduct are within one another, so that said conducts have one of the following configurations: said inner conduct contains the inversion conduct and the inversion conduct containing the outer conduct; the inner conduct contains both the inversion conduct and the outer conduct; or the inversion conduct contains both the inner conduct and the outer conduct.

9. The device for the controlled delivery of a product according to claim 1, further comprising a cap element fixedly or removably coupled to the neck of the container.

10. The device for the controlled delivery of a product according to claim 1, further comprising a cap element, said cap element and the neck of the container being substantially positioned at 90° with respect to a longitudinal axis of the container axis, to realize a lateral delivery.

11. The device for the controlled delivery of a product according to claim 1, wherein said inner conduct and outer conduct are on two different elements with edges of respective walls engaging each other by pressure, or by snapping coupling, or by ultrasound welding, so as to form the inversion conduct.

12. The device for the controlled delivery of a product according to claim 1, further comprising a cap covering said container, said cap comprising said outer conduct, said outer conduct comprising a plurality of radially extending vertical walls, wherein said inversion conduct comprises a receptacle shaped element, said first end of said inversion conduct has an edge having an inlet opening adjacent to an inner wall of the cap, an inner wall of said receptacle shaped container being coupled by pressure, or by ultrasound gluing with edges of said plural radially extending vertical walls.

13. The device for the controlled delivery of a product according to claim 1, further comprising a cap having a first element laterally hinged between the inner conduct and a first edge of the outer conduct so that said inner and outer conduct are separable from each other, and a cover laterally hinged to a second edge of the outer conduct and having a snapping closure means engaging the delivery opening.

14. The device for the controlled delivery of a product according to claim 1, further comprising a cap covering said container, said outer conduct being connect to the cap.

15. The device for the controlled delivery of a product according to claim 1, further comprising a cap engaged with the neck of the container, wherein said inversion conduct comprises a bottom re-entrant forming an inner receptacle provided with a tubular wall adjacent to the neck and having a bottom surface provided with an inlet communicating with said inner conduct.

16. The device for the controlled delivery of a product according to claim 1, wherein the first end of the outer conduct is substantially at half height of a receptacle of the inversion conduct, to allow the product level remaining within the inversion conduct, when the delivery is terminated and the container is inverted in the non-delivery position, to have a lower level with respect to said first end of the outer conduct, in such a way to make the inner air outflowing through a space obtained by a difference between the two levels, if subjected to a positive variation of volume and pressure.

17. The device for the controlled delivery of a product according to claim 1, further comprising a cap having a bottom wall spaced apart from the first end of the outer conduct, to prevent any product remaining within the inversion conduct from flowing out through the delivery opening, when the container is moved from a non-delivery position to a delivery position.

18. The device for the controlled delivery of a product according to claim 1, characterised in that the first end of the inversion conduct is provided with an upwardly directed recess formed by a concave or sloped wall, to allow the outer conduct to be extremely short, even if the first end of the outer conduct is substantially at half height of the inversion conduct, to limit a maximum level of the product that can remain within said outer conduct after delivery of the product, due to capillarity of the product.

19. The device for the controlled delivery of a product according to claim 1, wherein said outer conduct is substantially angled at 90° with respect to a longitudinal axis of said container and is outside a receptacle of the inversion conduct, the inversion conduct being provided with an upwardly directed sloped recess, so that the second end of the inversion conduct is higher than the first end, in a delivery position.

20. The device for the controlled delivery of a product according to claim 1, further comprising a means for opening and closing the first end of the outer conduct, said opening and closing means comprising a rotating cap containing said outer conduct, snapping coupled on the neck of the container and rotating within a tubular receptacle, said tubular receptacle having a bottom and an opposite end, said opposite end being engaged with an edge of the neck of the container and with a bottom of the rotating cap so that the first end of the outer conduct is closed by a bottom wall of a C-shaped tubular recess on the tubular receptacle, wherein said cap can rotate with respect to said bottom wall to open said first end of the outer conduct and to allow to the product to pass through the outer conduct to be delivered from the delivering opening.

21. The device for the controlled delivery of a product according to claim 1, further comprising:

a cap having a first inner receptacle inwardly extending from the cap; and axial push and pull means for opening and closing the first end of the outer conduct and that comprise a second slidable tubular receptacle having a bottom containing said outer conduct, a tubular wall and open opposite end, telescopically introduced, in slidable and hermetically sealing position, within a tubular wall of said first inner receptacle, said inversion conduct comprising a bottom of said first inner receptacle and said tubular wall of said second slidable tubular receptacle, said bottom of said first inner receptacle having said inner conduct there through and having a covering wall, wherein, in a closure position, the second slidable tubular receptacle is pushed within the first inner receptacle in such a way that the first end of said outer conduct can close on said covering wall, and wherein, in the delivery position, the second slidable tubular receptacle is pulled outward in such a way that the first end of said outer conduct is spaced apart from the covering wall, to allow the product to pass through the outer conduct and to be delivered from the delivery opening.

22. The device for the controlled delivery of a product according to claim 21, further comprising a projecting annular edge placed on the second slidable tubular receptacle, sliding within an annular groove on an end of an inner wall of the first inner receptacle.

23. The device for the controlled delivery of a product according to claim 1, further comprising:

a cap snapping coupled on the neck of the container and comprising an inwardly facing receptacle; and a screw roto-translation means for opening and closing the first end of the outer conduct and that comprise a movable opening and closure body, movably threadingly engaged on the cap, wherein the inversion conduct comprises a central part of a bottom of the movable opening and closure body and a wall of the inwardly facing receptacle, said central part of the bottom of the opening and closure movable body having an upwardly directed recess having a covering wall, so that when the delivery devise is in a closure position, effected by roto-translation caused by the screwing of the opening and closure movable body on the cap, the first end of said outer conduct can close on the covering wall, and so that when the delivery device is in the delivery position, the first end of said outer conduct is spaced apart, by roto-translation of the opening and closure movable body, from the covering wall, so as to allow the product to pass through the outer conduct and to be delivered from the delivery opening.

24. The device for the controlled delivery of a product according to claim 23, wherein said means for opening and closing further comprise an annular wall projecting from the bottom surface of the opening and closure movable body, said annular wall comprises a part of the inversion conduct and slidably and under pressure engages with an inner tubular wall of the inwardly facing receptacle.

25. A device for the controlled delivery of a flowable product within a container, said container comprising a material that is deformable by squeezing and able to energetically return to an original shape once the squeezing action is interrupted, said container having a neck and an outlet opening for said product to be delivered toward said device, said controlled delivery device comprising:

means for controlling delivery of the product, so that in a delivery position, the product to be delivered moves continuously from within said container to a first inner conduct communicating with said outlet opening, to a second inversion conduct having a first end communicating with said first inner conduct, and within which the product is directed according to a direction substantially opposed to gravity force during delivery of the product, and then to a third outer conduct having a first end communicating with a second end of said inversion conduct and having a delivery opening at a second end and then through said delivery opening, when said container is squeezed.

* * * * *